US007818852B2

(12) United States Patent
Van der Greft

(10) Patent No.: US 7,818,852 B2
(45) Date of Patent: Oct. 26, 2010

(54) CONNECTING SYSTEM FOR, INTER ALIA, AN EARRING

(75) Inventor: Nicolaas Van der Greft, Wychen (NL)

(73) Assignee: John Van Der Greft, Wychen (NL)

( * ) Notice: Subject to any disclaimer, the term of this patent is extended or adjusted under 35 U.S.C. 154(b) by 931 days.

(21) Appl. No.: 10/588,196

(22) PCT Filed: Jan. 28, 2005

(86) PCT No.: PCT/NL2005/000066

§ 371 (c)(1),
(2), (4) Date: Jan. 11, 2007

(87) PCT Pub. No.: WO2005/074740

PCT Pub. Date: Aug. 18, 2005

(65) Prior Publication Data

US 2007/0163298 A1 Jul. 19, 2007

(30) Foreign Application Priority Data

Feb. 4, 2004 (NL) ..... 1025401

(51) Int. Cl.
*A44C 7/00* (2006.01)

(52) U.S. Cl. ..... 24/705; 63/13; 24/453

(58) Field of Classification Search ..... None
See application file for complete search history.

(56) References Cited

U.S. PATENT DOCUMENTS 26,508 A * 12/1859 Marshall ..... 54/34
919,041 A * 4/1909 Lieberfreund ..... 24/705
1,209,783 A * 12/1916 Van Horn ..... 24/590.1
4,307,582 A * 12/1981 Mancini ..... 63/12
5,392,617 A 2/1995 Baldwin
2002/0163813 A1 11/2002 Tseng

FOREIGN PATENT DOCUMENTS

GB 2 224 633 5/1990

* cited by examiner

*Primary Examiner*—Jack W. Lavinder
(74) *Attorney, Agent, or Firm*—Oblon, Spivak, McClelland, Maier & Neustadt, L.L.P.

(57) ABSTRACT

What is disclosed is a connecting system, comprising an elongated element and a substantially ring-shaped element provided with an opening, into which said elongated element can be inserted for connection thereto. The elongated element comprises a connecting member, and the ring-shaped element comprises an opening configured to allow sliding passage of the elongated element with the connecting member in a specific angular position. The elongated element with the connecting member present thereon can only move through the opening, causing the two elements to be disconnected, in a specific angular position. The elongated element need not undergo any complex operations during manufacture thereof, and furthermore no complex turning movements or squeezing operations are required upon moving the elements together or apart. The connecting system is used as a suspension system, for example, or as a connecting system for an earring.

14 Claims, 3 Drawing Sheets

Figures 3A, 3B, 3C, 3D, 3E:
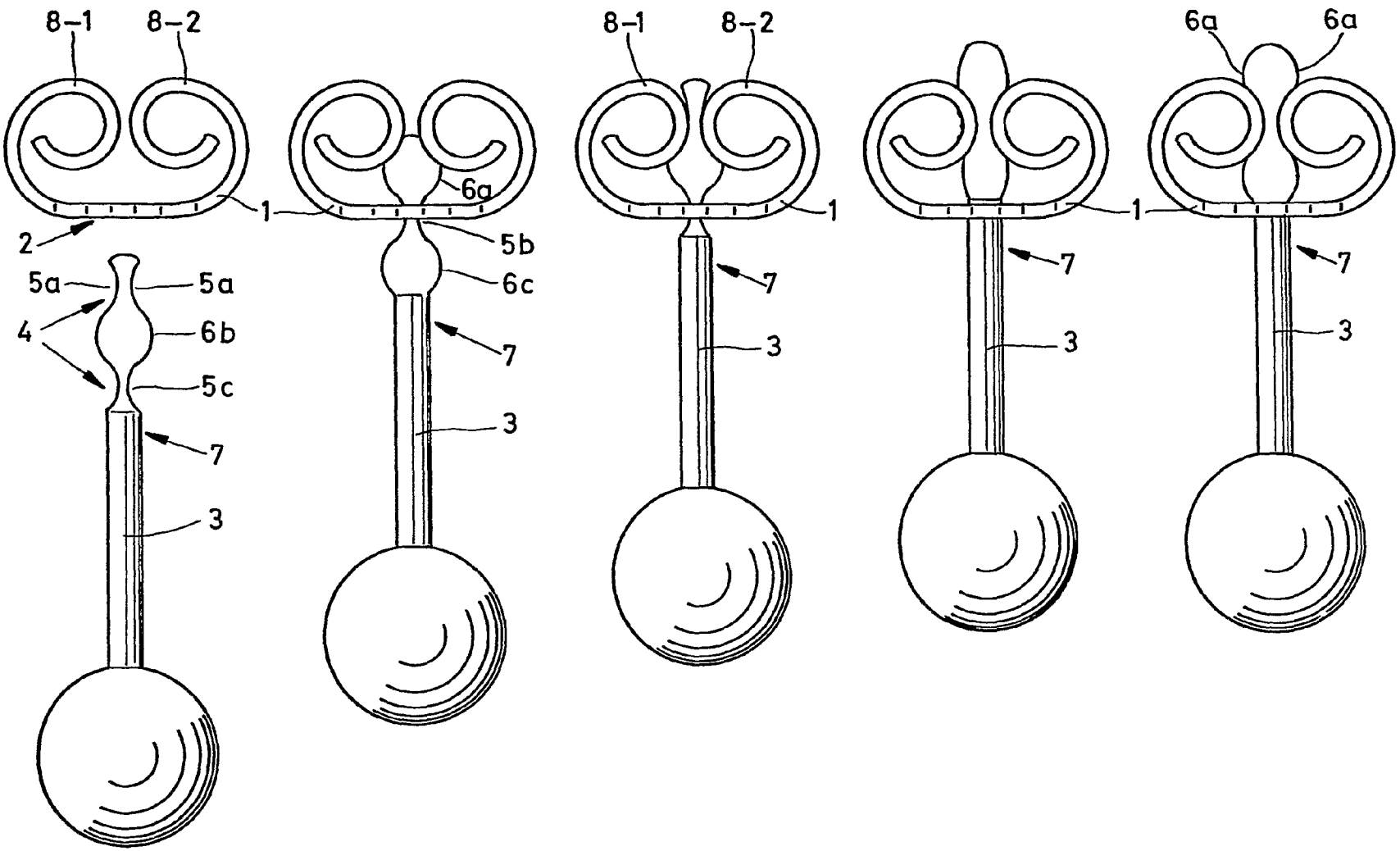

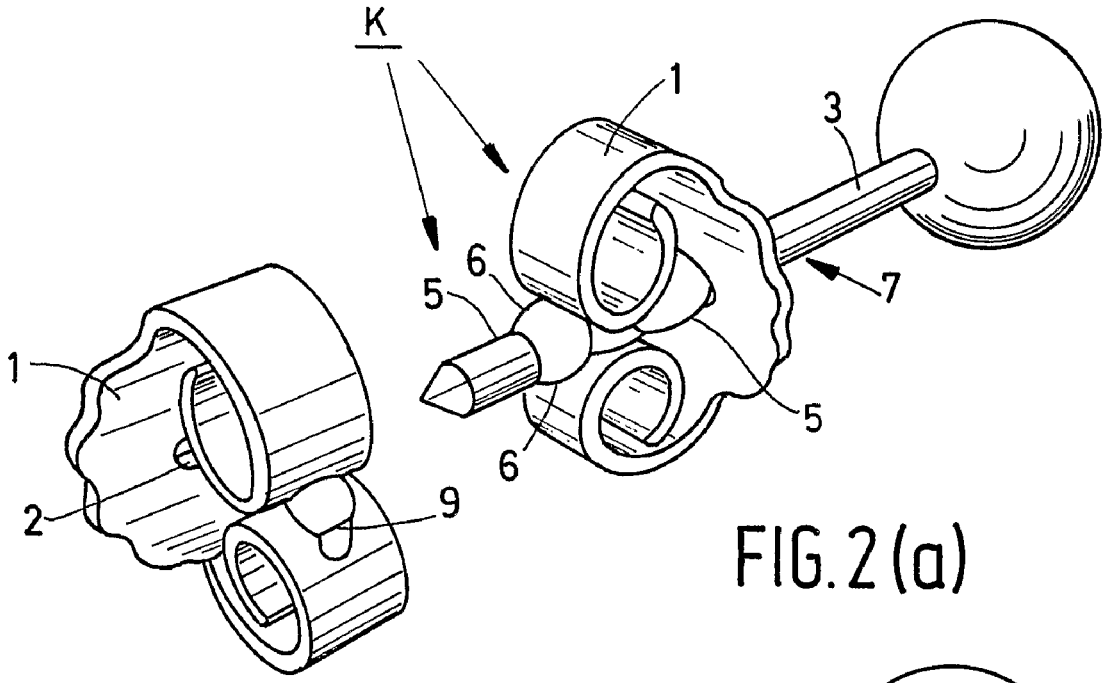
FIG. 2(a)
FIG.1(a)
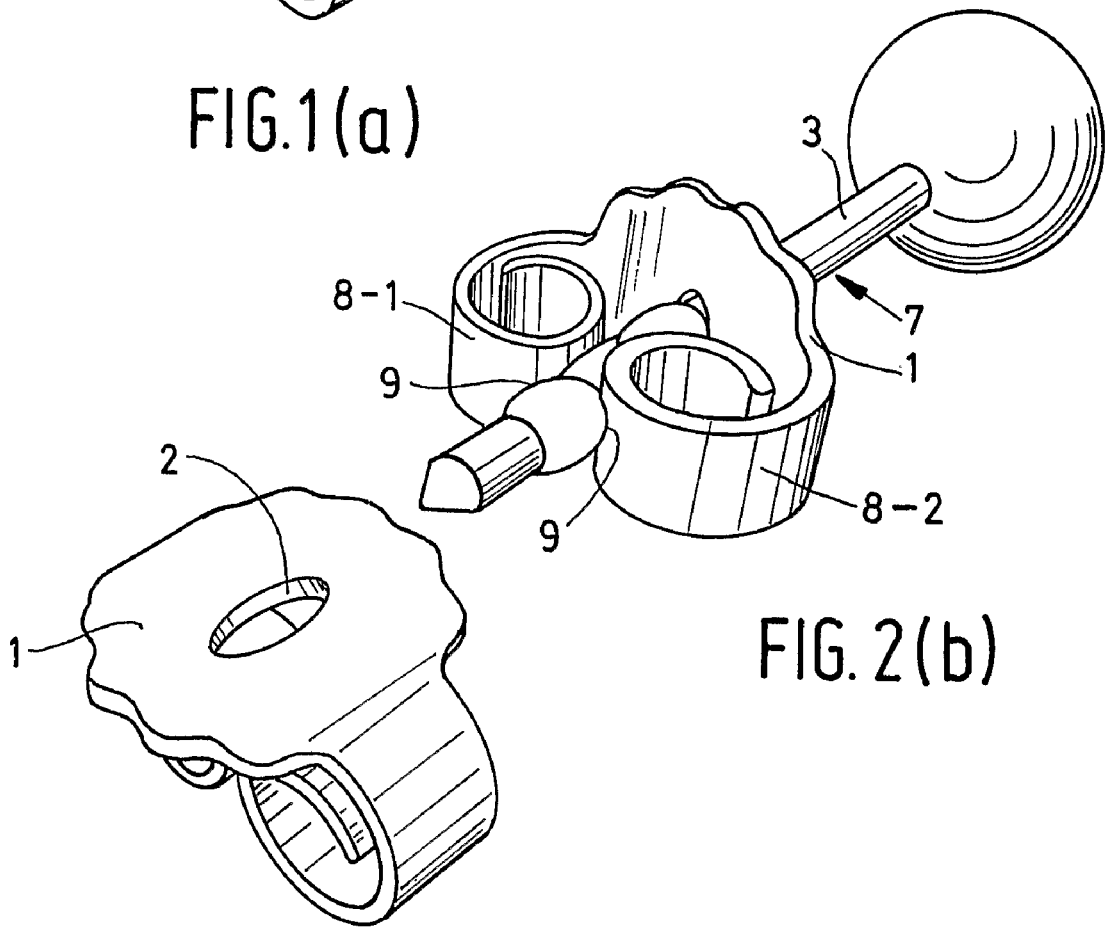
FIG. 2(b)
FIG.1(b)

CONNECTING SYSTEM FOR, INTER ALIA, AN EARRING

The present invention relates to a connecting system, comprising an elongated element and a substantially ring-shaped element provided with an opening, into which said elongated element can be inserted for connection thereto.

The invention also relates to a method for connecting and disconnecting the elements of the connecting system, and to an earring provided with such a connecting system.

A connecting system intended for connecting individual parts of an earring is known from WO 02/102183. The known earring connecting system comprises an elongated element in the form of an insertion element with a shank, and a ring-shaped element which, in the case of an earring, is configured as a sliding element provided with an opening for receiving the shank. The sliding element is furthermore provided with clamping means by which the sliding element, upon being connected to the shank, clamps down on the shank after the sliding element has been slid onto the shank. In squeezed-together condition, the clamping means can be slid over the shank without clamping down thereon.

A drawback of the known connecting system is the fact that a relatively complex squeezing operation is required for moving the ring-shaped element over the elongated element in squeezed-together condition upon connecting and/or disconnecting the elements of the connecting system.

The object of the present invention is to provide a connecting system which is easy to operate, which makes it possible to connect and/or disconnect a ring-shaped element and an elongated element, in particular, but not exclusively, for an earring, by using a simple method.

In order to accomplish that object, the connecting system according to the invention is characterized in that the elongated element comprises a connecting member, and in that the ring-shaped element comprises an opening configured to allow sliding passage of the elongated element with the connecting member in a specific angular position.

Accordingly, the method according to the invention is characterized in that the elongated element and the ring-shaped element are turned through a certain angle relative to each other, and in that the two elements are slidingly pushed together into a fixed angular position or pulled apart from said position.

The advantage of the connecting system and the method according to the invention is that a simple turning operation can be carried out, in which the ring-shaped element is turned over the elongated element, after which the ring-shaped element is locked in position on the elongated element after being simply moved together in a certain angular position and subsequent further rotation, from which position it cannot slide back or come loose. When subsequently the two elements are pulled apart, said movement apart is arrested as a result of the fact that the connecting member on the elongated element cannot pass through the opening in the ring-shaped element in any angular position. The elongated element with the connecting member present thereon can only pass through the opening in a specific angular position, causing the two elements to be disconnected from each other. The elongated element need not undergo any complex operations during manufacture, and furthermore no complex turning movements or squeezing operations are required upon moving the elements together or apart. A simple sliding movement will suffice in that case.

Another embodiment of the connecting system according to the invention is characterized in that the connecting member comprises two or more indentations and/or protrusions.

Such a connecting system is easy to manufacture by upsetting and/or flattening the elongated element, as a result of which a few, but possibly more, opposed indentations and/or protrusions are formed on the connecting member.

A preferred embodiment of the connecting system according to the invention is characterized in that the connecting member comprises two or more pairs of indentations and/or protrusions formed in spaced-apart relationship on the elongated element. The indentations and/or protrusions of the respective pairs may be arranged in staggered relationship round the elongated element.

In that case an advantageous double or multiple locking engagement of the ring-shaped element on the elongated element is realised. The locking engagement can only be released by repeated turning of the ring-shaped element with respect to the elongated element.

In another preferred embodiment, which is in particular suitable for use on an earring, the connecting member is characterized in that the ring-shaped element comprises means to be clamped on the elongated element.

In particular, the clamping means clamp down on or in the indentations and/or protrusions in that case, thus preventing undesirable turning of the elements with respect to each other, so that the elements cannot be unintentionally become disconnected from each other.

In yet another embodiment, springing ears of the connecting member lock in position in indentations on the elongated element. Simultaneously therewith, the clamping means may be supported on the elongated element in notches formed in the side of the springing clamping ears that face towards the elongated element.

Another embodiment of the connecting member according to the invention is characterized in that the connecting member is present at a specific location, which may or may not be at the end of the elongated element.

In the case of earrings, among other things, it is advantageous not to form the connecting member at the end of, in particular, the shank of the elongated element, since it will be very easy in that case to connect the two elements behind the ear in any angular position with respect to each other without subsequent turning thereof being required.

The present invention in particular relates to an earring provided with the aforesaid connecting means.

Figure 4A:
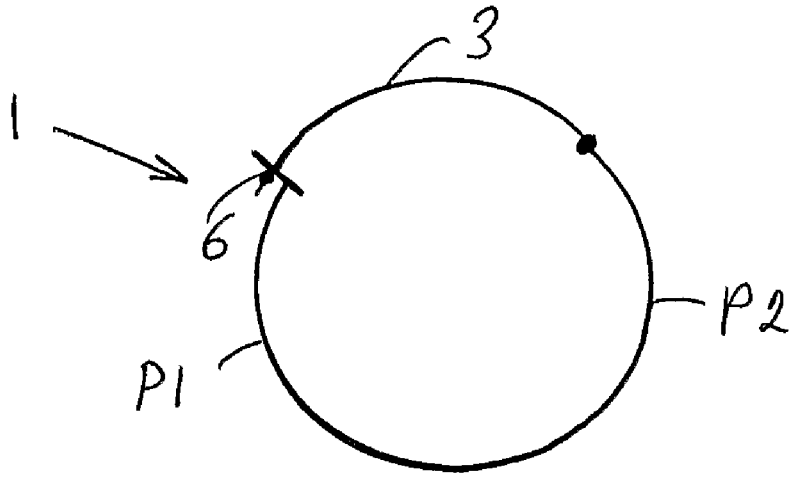
Figure 4B:
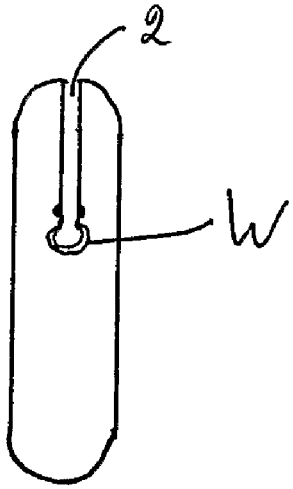

The present invention and its further advantages will now be discussed with reference to the accompanying drawing, in which like parts are indicated by the same numerals in the various figures. In the drawing:

FIGS. 1(*a*) and 1(*b*) show different positions of a disconnected ring-shaped element according to the invention, which is suitable for use in the connecting system according to the invention;

FIGS. 2(*a*) and 2(*b*) show different positions of the ring-shaped element, which is connected to an elongated element according to the invention, in which the connecting system according to the invention is used with an earring by way of example;

FIGS. 3(*a*), 3(*b*), 3(*c*), 3(*d*) and 3(*e*) show situations that successively occur during operations to be carried out upon effecting the connection of the connecting system according to the invention; and FIGS. 4(*a*) and 4(*b*) show another example of an earring provided with the connecting system according to the invention.

FIGS. 1(*a*) and 1(*b*) show a substantially ring-shaped (in this case) element 1, which is provided with an opening 2. FIGS. 2(*a*) and 2(*b*) show an elongated element 3, to which the ring-shaped element has been connected by insertion of the elongated element into the opening 2. In practice, the opening 2 has an elongated, in particular slightly oval shape, which is shown more clearly in FIG. 1(*b*). The elongated element 3 is provided with a connecting member 4 (see FIG. 3*a*) in the form of two or more nicks or indentations 5 and/or protrusions 6, which may be arranged behind each other, preferably in pairs.

If several pairs of indentations and/or protrusions 5, 6 are formed one behind the other on a shank 7 of the elongated element 3, said pairs will be arranged in staggered relationship round the shank. As a result of the combination of the shape of the opening 2 and the shape of the connecting element 4 that corresponds thereto in a specific angular position, the elements of the connecting system K thus formed can only be connected and disconnected in two specific angular positions of the elements 2 and 3 relative to each other.

The method to be used upon connecting the elements of the connecting system K will now be explained with reference to FIGS. 3(*a*), 3(*b*), 3(*c*), 3(*d*) and 3(*e*). FIG. 3(*a*) shows the elongated element 3, which approaches the opening 2 in the ring-shaped element 1. Corresponding indentations 5*a*, 5*b*, 5*c* and protrusions 6*a*, 6*b*, 6*c* are successively provided at corresponding positions along the element 3. Given the position of the opening 2 in the element 1 (see FIG. 1(*b*)), the opposed portions 5*a*, which may have been formed by an upsetting operation, for example, can be passed through the opening 2 in the position that is shown in FIG. 3(*a*), until the opening 2, because of its elongated shape, is stopped by the protrusion 6*b*. The elements 1 and 3 are then turned through 90 degrees relative to each other and pushed through, resulting in the situation as shown in FIG. 3(*b*), in which the protrusion 6*b* can pass through the opening 2. Further pushing through leads to the opening 2 being stopped by the protrusion 6*c*, after which turning through 90 degrees leads to the situation that is shown in FIG. 3(*c*), after which the indentation 5*c* can pass through the opening 2, after which the respective situations of FIGS. 3(*d*) and 3(*e*) occur. Subsequent pushing through and turning through 90 degrees of the elements 1 and 3 relative to each other enables a further release and pushing through, with the ring-shaped element 1 being able to move in longitudinal direction over the shank 7 of the elongated element 3, without impediment as regards the angular position. It cannot move off, however, because it will be stopped by the protrusion 6*c* in any angular position. If the protrusion 6*c* should happen to be able to pass through the opening 2 in that angular position, the elements 1 and 3 will be prevented from being moved further apart in that angular position by the protrusion 6*b*.

When the connecting system K is used with an earring, loss of the earring or the eardrop, possibly provided with a valuable stone, diamond, pearl or the like, is prevented in this manner. The connecting member 4 provided with indentations and protrusions 5 and 6 may be present at the end of the shank 7, as is shown in FIGS. 3(*a*)-3(*b*). It is also possible not to form the connecting member 4 at the end of the shank 7, and to start with a shank portion not provided with a connecting member 4 at the end, as it were, as is shown in FIGS. 2(*a*) and 2(*b*). The latter embodiment is advantageous when used with an earring, because it is not necessary to carry out a turning movement directly behind the ear already when connecting the elements 1 and 3. The fact is that said connecting can take place in any angular position of the elements relative to each other in that case.

FIGS. 3(*a*) . . . 3(*e*) further show that the ring-shaped element 1 comprises clamping means 8, in this case in the form of radially springing ears 8-1, 8-2, which are capable of clamping down on the shank 7 of the elongated element 3 in the various situations shown in FIGS. 3(*b*) . . . 3(*e*). FIGS. 3(*c*) . . . 3(*e*) show that the ears 8-1 and 8-2 clamp down in the indentations 5*a* and 5*b*, respectively, providing additional security in that situation against the elements 1 and 3 moving in longitudinal direction with respect to each other, but also against angular displacement of the elements 1 and 3 with respect to each other.

FIGS. 1(*a*) and 2(*b*) show best that the clamping ears 8 are provided with notches 9 facing towards the shank 7, in which the protrusion 6*a* clampingly abuts, as is shown in FIG. 3(*e*). This prevents undesirable rotation of the elements 1 and 3 relative to each other. The protrusions 6 7*a* are moved out of the notches 9 and the clamping engagement of the springing ears 8-1 and 8-2 by turning the elements 1 and 3 with some force with respect to each other.

The disconnecting of the two elements 1 by 3 takes place in the reverse order.

In the foregoing, the connecting system K has been explained on the basis of use thereof with an earring or an eardrop. The connecting system K can also be used with other suspension systems in which a locking engagement must be provided and in which the elements 1 a 3 must be prevented from coming loose. Think in this connection of the use of the system in suspension systems for objects, such as lowered ceilings, walls or fittings and the like.

FIGS. 4(*a*) and 4(*b*) show another example of a ring-shaped element 1, which is provided with an opening 2. FIG. 4(*a*) shows an elongated element 3, to which the ring-shaped element has been connected by sliding the elongated element into the opening 2, while two parts P1 and P2 of the earring 1 are somewhat pushed together, in order to provide the specific angular position, while passing through the opening 2. In practice, the opening 2 has an elongated shape, which is shown more clearly in FIG. 4(*b*). The elongated element 3 is provided with a connecting member 4 in the form of one or more nicks, knobs or protrusions 6. The knob 6 locks into a widened part W at the lower end of the opening 2, when the parts P1 and P2 are loosened.

The invention claimed is:

1. A connecting system, comprising:

an elongated element including a connecting member, the connecting member having an engaging portion; and a receiving element including an opening, the opening being shaped to allow sliding passage of the elongated element such that, with respect to a central axis of the elongated element, a shape of the engaging portion is aligned with a shape of the opening in a first angular position, whereby the connecting member passes through the opening, and in a second angular position different from the first angular position, interference exists between a surface of the engaging portion and a surface of the receiving element thereby preventing the connecting member from passing through the opening, wherein the engaging portion of the connecting member includes at least a pair of opposed indentations and/or protrusions, and wherein the at least a pair of opposed indentations and/or protrusions are arranged in staggered relationship around the elongated element at alternating angular positions.

2. The connecting system according to claim 1, wherein the engaging portion of the connecting member includes two or more pairs of indentations and/or protrusions formed in spaced-apart relationship on the elongated element.

3. The connecting system according to claim 1, wherein the indentations and/or protrusions are formed by upsetting or flattening.

4. The connecting system according to claim 1, wherein the receiving element includes clamping means for clamping onto the elongated element.

5. The connecting system according to claim 4, wherein the clamping means are configured to clamp around the connecting member.

6. The connecting system according to claim 4 or 5, wherein the clamping means is configured for clamping down on indentations.

7. The connecting system according to claim 4, wherein the clamping means is springing ears.

8. The connecting system according to claim 4, wherein the clamping means includes notches, such that the elongated element is adjacent to the notches after passing through the opening.

9. The connecting system according to claim 1, wherein the connecting member is proximate to an end of the elongated element.

10. An earring, comprising:

the connecting system according to claim 1, wherein the elongated element is a shank element and the receiving element is a sliding element, which allows sliding passage of the shank element with the connecting member in an angular position.

11. A suspension system for objects, comprising:

the connecting system according to claim 1, wherein the objects are suspended from a ceiling.

12. The connecting system according to claim 1, wherein the receiving element is substantially ring-shaped.

13. The connecting system according to claim 1, wherein the shape of the engaging portion and the shape of the opening is substantially ovular.

14. A method for connecting and disconnecting elements of a connecting system, comprising:

aligning an elongated element and a receiving element at an angle relative to each other, such that in a first angular position, a shape of an engaging portion of a connecting member aligns with a shape of an opening of the receiving element, and in a second angular position different from the first angular position, the shape of the engaging portion interferes with the shape of the opening;

performing one of pushing the elements together or pulling the elements apart while in the first angular position such that the engaging portion passes through the opening;

repeating the aligning such that a subsequent engaging portion of the connecting member aligns with the opening, wherein the subsequent engaging portion is substantially similar in shape as the engaging portion and at least one subsequent engaging portion nearest to the engaging portion is disposed at an angle different from a position of the engaging portion; and repeating the performing one of pushing the elements together or pulling the elements apart, such that the subsequent engaging portion passes through the opening.

* * * * *